US006501214B1

(12) United States Patent
Sakamoto et al.

(10) Patent No.: US 6,501,214 B1
(45) Date of Patent: Dec. 31, 2002

(54) COLOR CATHODE RAY TUBE

(75) Inventors: Hideharu Sakamoto, Itabashi (JP); Nobuhiko Hosotani, Mobara (JP); Koji Hagiwara, Chosei (JP)

(73) Assignee: Hitachi Ltd., Tokyo (JP)

( * ) Notice: Subject to any disclaimer, the term of this patent is extended or adjusted under 35 U.S.C. 154(b) by 121 days.

(21) Appl. No.: 09/679,169

(22) Filed: Oct. 4, 2000

(30) Foreign Application Priority Data

Oct. 8, 1999 (JP) ..... 11-288035

(51) Int. Cl.[7] ..... H01J 29/07
(52) U.S. Cl. ..... 313/407
(58) Field of Search ..... 313/402, 403, 313/404, 405, 406, 407, 408

(56) References Cited

U.S. PATENT DOCUMENTS 4,767,962 A 8/1988 Adler et al.
4,942,333 A 7/1990 Knox

FOREIGN PATENT DOCUMENTS

| | | |
|---|---|---|
| EP | 0 924 741 A1 | 6/1999 |
| FR | 2.151.051 | 4/1973 |
| FR | 2.218.648 | 9/1974 |
| FR | 2 756 971 | 6/1998 |
| JP | 08-298078 A | 11/1996 |
| JP | 09-035657 A | 2/1997 |

*Primary Examiner*—Nimeshkumar D. Patel
*Assistant Examiner*—Thelma Sheree Clove
(74) *Attorney, Agent, or Firm*—Milbank, Tweed, Hadley & McCloy LLP

(57) ABSTRACT

A color cathode ray tube can reduce a warp amount derived from a spring back after shaping a shadow mask and can suppress the deformation of a main surface of the shadow mask after fixedly securing the shadow mask and a mask frame to each other. The color cathode ray tube includes tongue portions which are protruded from distal ends of skirt portions of the shadow mask and a plurality of stress absorption holes are formed in the tongue portions.

19 Claims, 5 Drawing Sheets

COLOR CATHODE RAY TUBE

BACKGROUND OF THE INVENTION

The present invention relates to a color cathode ray tube, and more particularly to a color cathode ray tube which is capable of preventing the deformation of a color selection electrode such as a shadow mask.

A color cathode ray tube, for example, a shadow-mask type color cathode ray tube employed by a color television set, a color display monitor for an OA apparatus terminal or the like includes an evacuated envelope which is comprised of an approximately rectangular panel portion which has a phosphor screen including a large number of dot-like or stripe-like phosphor picture elements, an approximately tubular neck portion accommodating an electron guns and an approximately funnel-like funnel portion which connects the neck portion and the panel portion. In the evacuated envelope, a shadow mask which constitutes a color selection electrode having a large number of electron beam apertures is disposed. That is, the shadows mask is disposed close to the phosphor screen, faces the phosphor screen in an opposed manner and is. fixedly secured to a mask frame.

This shadow mask mainly uses aluminum killed steel as a constituent material. Recently, along with efforts to seek for higher definition of color cathode ray tubes, shadow masks having a thin plate thickness have been used. With respect to a color cathode ray tube adopting such a shadow mask having a thin thickness, a portion thereof is thermally deformed during its operation and a phenomenon called a mask doming which displaces electron beam spots from given positions on the phosphor screen is liable to occur. To cope with this phenomenon, a shadow mask suspension mechanism has been improved and furthermore Invar material is used as the constituent material of the shadow mask in view of the thermal expansion rate and the physical hardness.

In manufacturing such a shadow mask, an original plate having a large number of above-mentioned electron beam apertures at given positions by etching is blanked out to a given shape. Then, the blanked plate is formed by a press into a shape which includes a main surface having an approximately spherical plane and skirt portions contiguously connected to the periphery of this main surface and are bent at approximately 90 degrees relative to the main surface. Then, this shaped shadow mask is fixedly secured to the above-mentioned mask frame to constitute a mask assembly.

In the above-mentioned shaped shadow mask, a so-called spring back is generated in the skirt portions and hence, a warping is generated on the skirt portions in an outside direction, that is, in a direction to move away from a tube axis. When the skirt portions are fixedly secured to the mask frame portion in such a state, a deformation derived from the warping of the skirt portions is generated at a portion of the main surface of the shadow mask.

Various countermeasures have been proposed in the past to prevent such deformation. That is, first of all, Japanese Laid-open Patent Publication 112566/1974 discloses a technique which prevents deformation by locally thinning the thickness of a peripheral portion of the main surface of the shadow mask. Further, Japanese Laid-open Patent Publication 271849/1988 discloses a technique which prevents deformation by setting the length of the skirt portions of the shadow mask to a specific value relative to the outer diameter dimension of the panel, by providing tongues which protrude from the skirt portions in a direction away from the main surface approximately parallel to the tube axis and by fixedly securing the tongues to the mask frame.

Further, Japanese Laid-open Patent Publication 169847/1989 discloses a technique which prevents deformation by forming a large number of approximately circular small holes in the skirt portions at the comer portions of the shadow mask. Still further, Japanese Laid-open Patent Publication 35657/1997 discloses a technique which prevents deformation by forming a plurality of stress absorption holes in the skirt portions of the shadow mask. Furthermore, a technique which prevents the deformation by thinning the area ranging from the end portion of the main surface to the skirt portions by forming non-through holes or grooves on such an area is disclosed in various publications.

Still further, with respect to the technique disclosed in the above-mentioned Japanese Laid-open Patent Publication 271849/1988 which provides the tongues protruding from the skirt portions in a direction away from the main surface approximately parallel to the tube axis and fixedly secures the tongues to the mask frame to prevent the landing failure caused by the thermal. expansion of the shadow mask, such a technique is also disclosed in Japanese Laid-open Utility Model publication 5657/1973, Japanese Laid-open Patent Publication 73970/1974, Japanese Laid-open Patent Publication 72545/1990, Japanese Laid-open Patent Publication 22048/1992 and the like.

SUMMARY OF THE INVENTION

The techniques for reducing the spring back disclosed in the above-mentioned respective publications can expect the deformation prevention effect to some extent compared to structures which do not employ these kinds of techniques.

However, the conventional technique which thins the thickness of the area ranging from the end portion of the main surface to the skirt portions or forms through holes only in the skirt portions has a limit and hence is still insufficient in preventing the deformation. Further, with respect to the shadow mask having the large radius of curvature of the main surface, there has been a problem that the deformation prevention effect can be hardly expected.

Further, with respect to the above-mentioned technique which simply forms tongues protruding from the skirt portions in the direction away from the main surface approximately parallel to the tube axis and fixedly secures these tongues to the mask frame, it gives rise to another problems that the reduction of the spring back of the skirt portions is difficult and the tongues fixedly secured to the mask frame are displaced in a heating step or the like during a manufacturing process of color cathode ray tubes and this causes the deformation of the main surface. The same goes for the techniques employing tongues disclosed in the above-mentioned respective publications and hence, a further countermeasure is requested.

Accordingly, it is a typical object of the present invention to provide a color cathode ray tube which can prevent the deformation of a color selection electrode such as a shadow mask.

To describe the typical constitutions of the present invention for achieving the above-mentioned object, they are as follows.

(1) In a shadow mask (a color selection electrode) including a main surface (apertured region) having a large number of electron beam apertures, skirt portions which are bent perpendicular to this main surface and tongue portions which are protruded from distal ends of the skirt portions in a direction away from the main surface, stress absorption holes are formed in the skirt portions and the tongue portions respectively.

Due to such a constitution (1), a warping amount of the skirt portions of the color selection electrode by the spring back can be reduced and further the displacement caused by a heating step of the tongue portions can be prevented thus eliminating the deflection of the main surface.

(2) The dimensions of the stress absorption holes formed in the skirt portions and the tongue portions are changed.

(3) The dimension of the stress absorption holes formed in the tongue portions is made larger than the dimension of the stress absorption holes formed in the skirt portions.

Due to the above-mentioned constitutions (2)(3), a warping amount of the skirt portions can be reduced and furthermore the problem derived from the above-mentioned displacement of the tongue portions can be absorbed by the stress absorption holes formed in the portions and hence, the deformation of the main surface is suppressed.

(4) The stress absorption holes formed in the skirt portions are formed around the whole periphery except for the corner portions, portions disposed at both sides of the corner portions and the tongue portions of the color selection electrode.

Due to the constitution (4), the height of the skirt portions at the corner portions can be made short and a warping amount of the skirt portions can be reduced.

(5) The stress absorption holes are arranged such that a line which connects the centers of a plurality of stress absorption holes becomes approximately parallel to a line which connects a plurality of fixed points which fix the tongue portions and the mask frame.

Due to the constitution (5), the function to hold the electrodes uniformly along the peripheral direction of the skirt portions can be obtained.

(6) The sum of the opening areas of a plurality of stress absorption holes formed in the tongue portion occupies 25% of the area of the tongue portion.

Due to the constitution (6), the deformation of the main surface derived from the displacement of the tongue portions can be reduced.

(7) The distance from the distal end of the tongue portion to the stress absorption holes is set to equal to or more than 3 mm.

Due to the constitution (7), the occurrence of cracks which may be caused by press forming can be prevented.

(8) Corner pieces provided to the corner portions and the mask frame are fixedly secured to each other.

Due to the constitution (8), fixing of the corner portions of the color selection electrode and the mask frame can be performed together with the tongue portions having the stress absorption holes thus further reducing the deformation of the main surface.

(9) In an approximately rectangular shadow mask (a color selection electrode) including a main surface (apertured region) having a plurality of electron beam apertures, skirt portions which are bent perpendicular to this main surface and tongue portions which are protruded from a distal end of the skirt portions in a direction away from the main surface, the color selection electrode includes stress absorption holes in the tongue portions and equivalent radius of curvature along the long axis of the main surface is set to equal to or more than 1250 mm.

Due to the constitution (9), the distortion of images can be avoided and furthermore the increase of a warping amount of the skirt portions brought about corresponding to the increase of the radius of curvature can be suppressed.

Corner pieces which are fixedly secured to the mask frame are provided to the corners of the color selection electrode.

(10) In an approximately rectangular shadow mask (a color selection electrode) including a main surface (apertured region) having a plurality of electron beam apertures, skirt portions which are bent perpendicular to this main surface and tongue portions which are protruded from a distal end of the skirt portions in a direction away from the main surface, the color selection electrode includes stress absorption holes in the tongue portions and substantially the whole of the color selection electrode is made thin except for a region where the electron beam apertures are formed and portions of the tongue portions.

Due to the constitution (10), the deformation of the main surface is further reduced by the coupled effects consisting of the effect brought about by the stress absorption holes formed in the tongue portions and the thinning effect.

DESCRIPTION OF THE PREFERRED EMBODIMENTS

Embodiments of the present invention are explained hereinafter in detail in conjunction with drawings.

Figure 1:
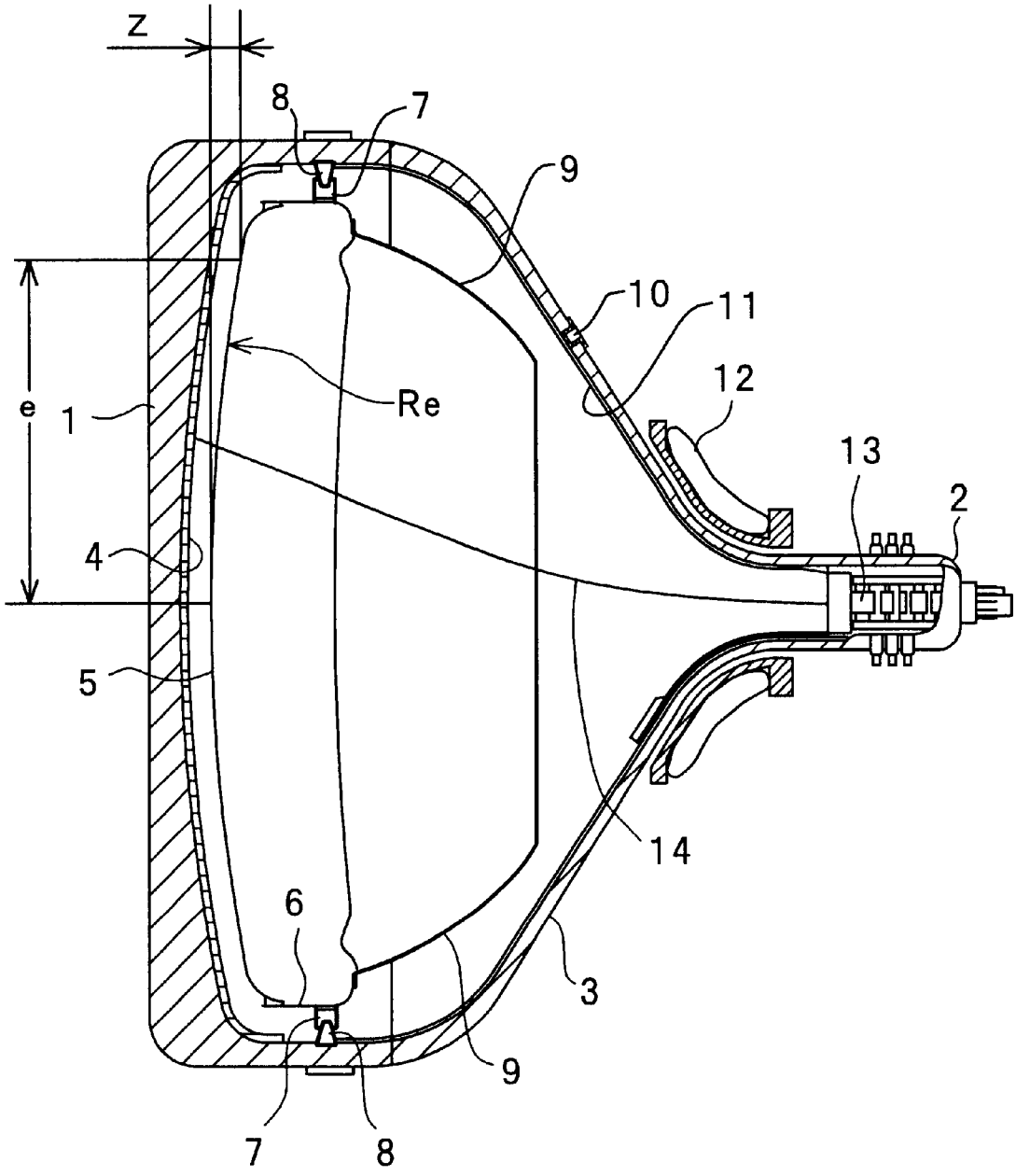
FIG. 1 is a cross-sectional view for explaining an example of the whole structure of a shadow mask type color cathode ray tube showing one embodiment of the present invention.

FIG. 1 is a cross-sectional view for explaining an example of the whole structure of a shadow-mask type color cathode ray tube showing one embodiment of the present invention.

In FIG. 1, numeral 1 indicates a panel portion, numeral 2 indicates a neck portion, numeral 3 indicates a funnel portion, numeral 4 indicates a phosphor film, numeral 5 indicates a shadow mask which constitutes a color selection electrode having a large number of electron beam apertures, numeral 6 indicates a mask frame having a structure which will be explained later for fixing and holding the shadow mask 5 and the like. Numeral 7 indicates a spring, numeral 8 indicates a panel pin, numeral 9 indicates a magnetic shield, numeral 10 indicates an anode button, numeral 11 indicates an interior conductive film, numeral 12 indicates a deflection yoke which deflects electron beams in the horizontal direction and the vertical direction, and numeral 13 indicates an electron gun for emitting three electron beams 14 (one center electron beam and two side electron beams).

In the drawing, in the inside of the panel portion 1 which has the phosphor film 4 on an inner surface thereof, the mask frame 6 which fixedly secures the shadow mask 5 and the magnetic shield 9 and the like thereto is mounted on panel pins 8 in a suspended manner by means of springs 7. The panel portion 1 and the funnel portion 3 are fixedly secured to each other by welding using frit glass. Then, the electron gun 13 is inserted into the neck portion 2 and is vacuum sealed.

The electron beams 14 emitted from the electron guns 13 receive the deflection in two directions consisting of the horizontal and vertical directions by the deflection yoke 12 which is mounted on a transitional portion between the neck portion 2 and the funnel portion 3 and impinge on the phosphor film 4 after passing through the electron beam apertures of the shadow mask 5 which constitutes the color selection electrode.

Recently, along with the popularization of color television sets and color display monitors of a flat screen type, in color cathode ray tubes used in these sets and monitors, a tendency that their face plates (panel glasses) are gradually flattened can be observed.

The embodiment of the present invention shown FIG. 1 illustrates the shadow-mask type color cathode ray tube of a flat type. In FIG. 1, the panel portion 1 has an approximately flattened outer surface and an inner surface which is curved so as to form a recessed surface. The shadow mask 5 is formed by shaping the shadow mask original plate into a given curved surface by press forming and is curved following the inner surface of the panel portion 1. The reason why the inner surface of the panel portion 1 and the shadow mask 5 are curved while the outer surface of the panel portion 1 is held approximately flat is that the manufacturing method of the shadow mask 5 by the press molding technique becomes simple and inexpensive.

An apertured region (a main surface) of the shadow mask 5 in which a large number of electron beam apertures are formed has an approximately rectangular shape and respective radii of curvature along the long axis, along the short axis and along the diagonal axis are made different from each other. This design is made so as to satisfy both of the feeling of flatness of the screen required as the color cathode ray tube and the maintenance of the mechanical strength of the shaped shadow mask.

The curved surface of the shadow mask 5 according to this embodiment is a non-spherical surface which gradually decreases the radii of curvature along the long axis, along the short axis and the diagonal axis respectively from the center to the periphery of the main surface 21. The radius of curvature Rx along the long axis is varied within a range from 1450 mm to 1250 mm, the radius of curvature Ry along the short axis is varied within a range from 2000 mm to 1300 mm, and the radius of curvature Rd along the diagonal axis is varied within a range from 1600 mm to 1250 mm.

The curvature of the shadow mask having the non-spherical shape is defined as follows when expressed by the equivalent radius of curvature Re.

$$Re=(z^2+e^2)/2z$$

Wherein, e: distance (mm) in the direction perpendicular to the tube axis from the center of the main surface of the shadow mask to an arbitrary peripheral position z: fall amount (mm) in the tube axis direction at the above-mentioned arbitrary peripheral position from the center of the main surface of the shadow mask As mentioned above, with respect to the long axis, even when the radius of curvature is more or less smaller than the radius of curvature along the short axis, the feeling of flatness is not damaged and hence, it is sufficient so long as the radius of curvature is set equal to or more than 1250 mm.

Figure 2:
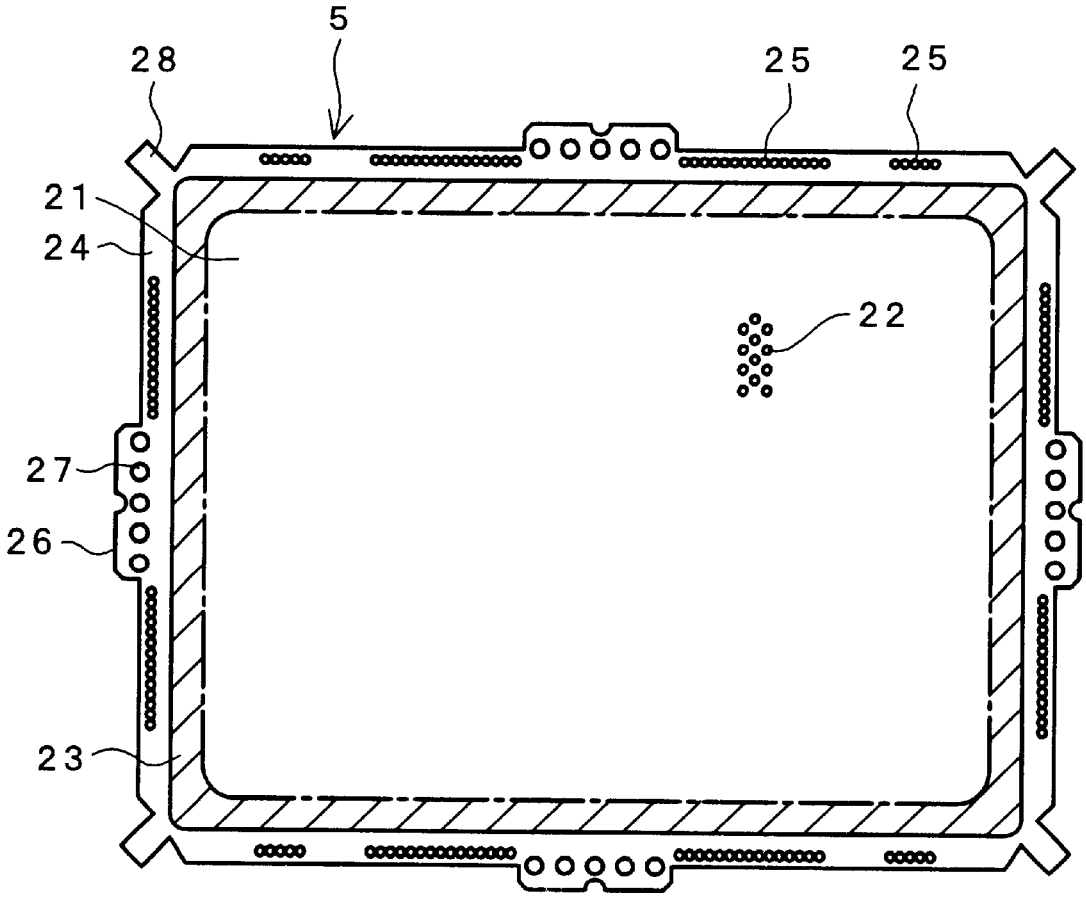
FIG. 2 is a plan view of a shadow mask original plate before shaping used in the color cathode ray tube of the present invention.

FIG. 2 is a plan view showing one example of a shadow mask original plate before shaping used in a color cathode ray tube of the present invention. in the drawing, numeral 21 indicates a shadow mask main surface. The shadow mask main surface 21 is a portion which faces the phosphor film formed on the panel portion after shaping. The shadow mask main surface 21 is provided with a large number of electron beam apertures 22 and an outer peripheral portion 23 indicated by hatching is formed of a non-apertured portion. Numeral 24 indicates skirt portions and these skirt portions 24 are disposed at long and short sides disposed at the outside of the peripheral portion 23. The skirt portions 24 have a large number of stress absorption holes 25 formed of elliptically shaped through holes. Numeral 26 indicates tongue portions and these tongue portions 26 are continuously provided to the distal end portions of the skirt portions 24 at the center of respective sides. Each tongue portion 26 is provided with stress absorption holes 27 formed of circular through holes. Numeral 28 indicates corner members provided to respective corner portions and these corner members 28 are fixedly secured to respective corner portions of the mask frame 6. The stress absorption holes 25 are not formed in portions of the skirt portions 24 disposed at both sides of the corner members 28. The approximately entire surface of the shadow mask original plate is made thin by etching except for portions disposed in the vicinity of the distal end portions of the tongue portions 26 which are fixedly welded to the mask frame and the portion where the electron beam apertures are formed. Although the tongue portions 26 are formed in respective long and shorts sides in this embodiment, it may be possible to make the short sides have only the skirt portions and to make only the long sides have the tongue portions.

Figure 3:
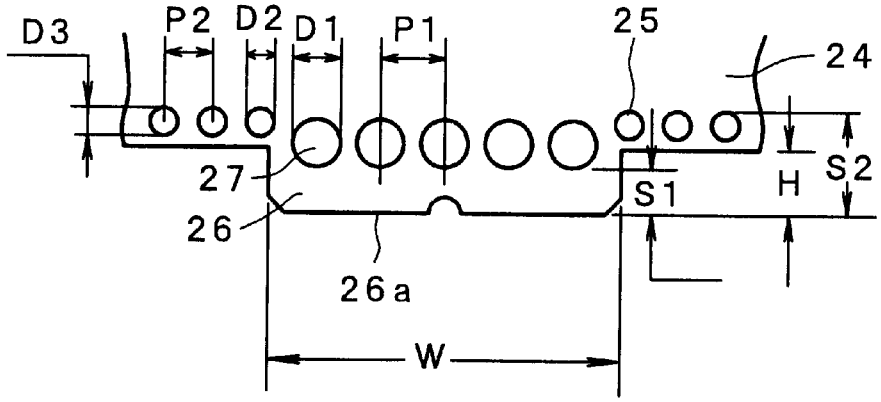
FIG. 3 is a plan view of an essential part showing a part of FIG. 2 in an enlarged form.

FIG. 3 is a plan view of an essential part showing a portion of FIG. 2 in an enlarged form, wherein same numerals are given to parts identical to those shown in FIG. 2. In FIG. 3, the diameter and the pitch of the stress absorption holes 27 formed in the tongue portions 26 are indicated by D1 and P1 respectively, the short diameter, the long diameter and the pitch of the stress absorption holes 25 formed in the skirt portions 24 are indicated by D2, D3 and P2, the height of the tongue portions 26 is indicated by H, the distance from distal end portions 26*a* of the tongue portions 26 to the stress absorption holes 27 is indicated by S1, the distance from distal ends 26*a* of the tongue portions 26 to the upper ends of the stress absorption holes 25 is indicated by S2 and the width of the tongue portions 26 is indicated by W. Further, respective stress absorption holes 27 are arranged approximately parallel to the peripheral direction of the outer peripheral portion 23 and further they are aligned with each other. Still further, respective stress absorption holes 25 are also arranged approximately parallel to the peripheral direction of the outer peripheral portion 23 and further they are aligned with each other.

To show a specific example of respective dimensions, an example of dimensions of a shadow mask type color cathode ray tube of a type whose diagonal diameter of the effective screen is 46 cm is shown. First of all, to review the relationship with respect to the tongue portions 26, respective dimensions become as follows; the diameter D1: 6 mm, the pitch P1: 8 mm, the distance S1: 5.5 mm, the height H: 7 mm, the width W: 44 mm. Then, to review the relationship with respect to the skirt portions 24, respective dimensions become as follows; the short diameter D2: 2.3 mm, the long diameter D3: 2.6 mm, the pitch P2: 6 mm, the distance S2: 12.3 mm. Further, the height of the skirt portion 24 is set to 10 mm at the centers of the long sides and is set to 7 mm at positions approximately 30 mm away from the corner portions where the stress absorption holes 25 are not formed.

Although these respective dimensions are set to various values in view of the effective screen (spherical) size of the cathode ray tubes, the definition of the phosphor screen pixels (phosphor picture elements) and the like, if the distance S1 is set to equal to more than 3 mm, the cracks on the skirt portions which may be caused by the press shaping can be effectively prevented. Accordingly, it is desirable to set the distance S1 to equal to or more than 3 mm.

Then, results of models are explained. Four specifications are prepared with respect to the stress absorption holes as shown in Table 1.

TABLE 1

| specification | diameter of hole (mm) | pitch (mm) | opening rate (%) |
|---|---|---|---|
| A | No holes | 0 | 0 |
| B | 5 | 10 | 30 |
| C | 3 | 5 | 35 |
| D | 5 | 8 | 40 |

opening rate (%): (sum of hole portion areas/tongue portion area)×100%

The results on the warping amount of the skirt portion of these four specifications after the press operate and the mechanical characteristics after assembling of the shadow mask to the mask frame are shown in Table 2 and Table 3 respectively.

TABLE 2

| warping amount of skirt portion after pressing | | | | |
|---|---|---|---|---|
| specification | A | B | C | D |
| on long axis | 4.2 | 3.4 | 2.9 | 2.5 |
| on short axis | 4.5 | 3.9 | 3.2 | 2.6 |

TABLE 3

| mechanical characteristics after assembling | | |
|---|---|---|
| Specification | Displacement amount of main surface(mm) | Drop strength ($m/s^2$) |
| A | 0.16 | 216 |
| B | 0.06 | 265 |
| C | 0.02 | 274 |
| D | 0 | 294 |

From the above results, it is understood that when the opening rate of a plurality of stress absorption holes formed in the tongue portion exceeds 25% of the area of the tongue portion, the warping amount after press shaping is reduced and this effect is remarkably recognized even after assembling of the shadow mask to the mask frame. On the other hand, when the opening rate exceeds 60%, a tendency that the drop strength of the tongue portion per se is lowered is observed.

The above-mentioned drop strength is obtained by a method which has been carried out as a general test method of a color cathode ray tube. That is, a completed bulb shown in FIG. 1 is accommodated in a test box formed like a packaging box with a panel surface thereof directed upwardly, and then a probe is mounted approximately on the center of the outer surface of the panel. Then, under this state, the completed bulb is dropped from a given height together with the test box and the drop strength is obtained from the measured value of the probe.

Figure 4:
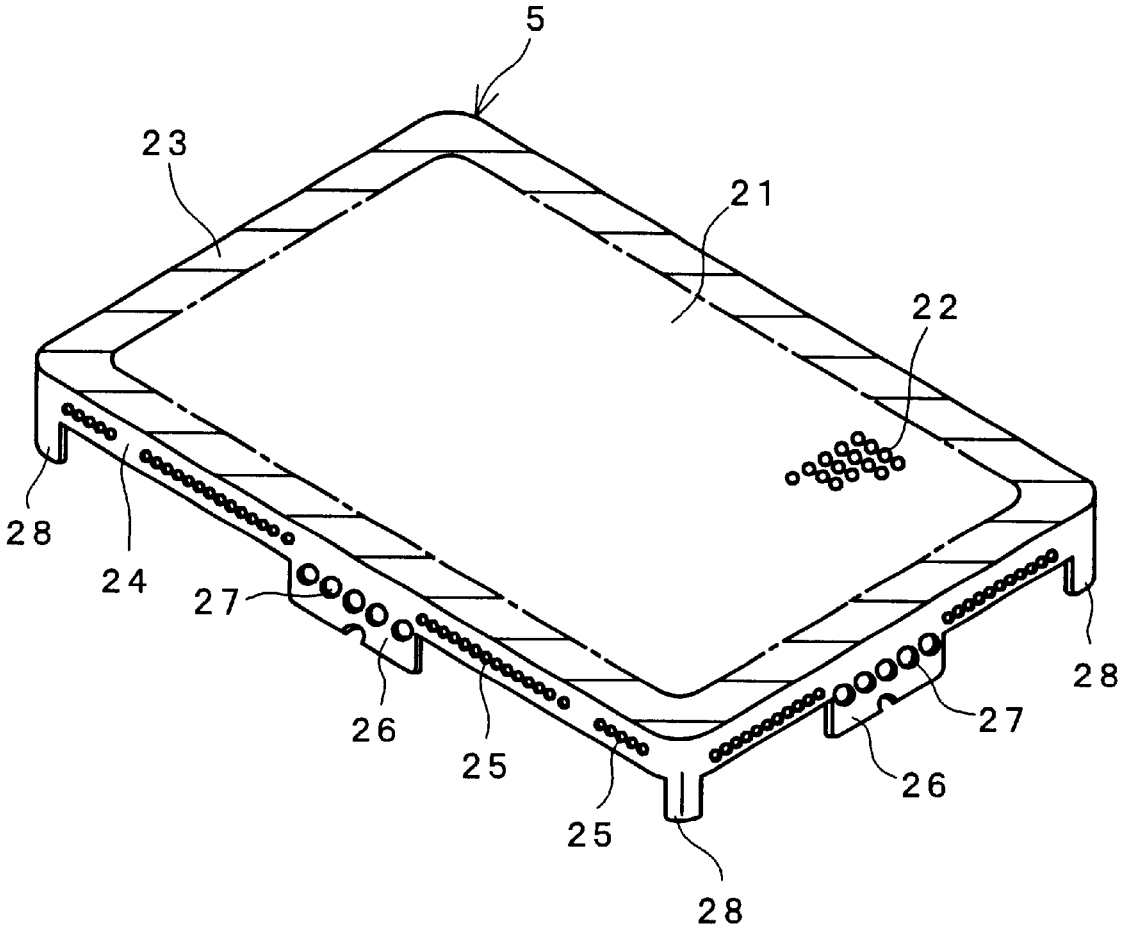
FIG. 4 is a perspective view showing the shadow mask which is shaped by a press.

FIG. 4 is perspective view of the shadow mask 5 which is shaped by a press using the shadow mask original plate before shaping which is shown in FIG. 2.

In FIG. 4, the main surface 21 is shaped with given radius of curvatures and the skirt portions 24 are bent approximately perpendicular to this main surface 21. The tongue portions 26 are mounted on the approximately center of respective long and short sides and these tongue portions are respectively provided with stress absorption holes 27. On the other hand, although the dimension is different, the stress absorption holes 25 are respectively formed in the skirt portions 24 at respective sides.

The radius of curvature of the main surface 21 is set in conformity with the radius of curvature of the inner surface of the panel portion. As shown in FIG. 1, the outer surface (front surface) of the panel portion is approximately flat. The inner surface of the panel portion is curved such that the thickness of the peripheral portion is approximately twice as thick as that of the center as shown in FIG. 1 in view of the strength of the evacuated envelope as well as in view of the shaped strength of the shadow mask. Here, to maintain the feeling of flatness of the screen of the color cathode ray tube in view of the relationship with the inner surface of the panel portion, the equivalent radius of curvature of the main surface of the shadow mask is preferably made equal to or more than 1250 mm along the long axis. With respect to shadow mask which requires such a radius of curvature, the above object can be achieved by applying the present invention to the skirt portions and the tongue portions.

Figure 5:
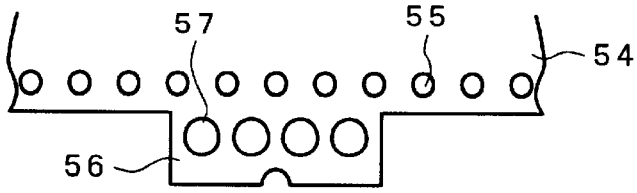
FIG. 5 is a side view of an essential part for explaining another example of a tongue portion of a color selection electrode used in the color cathode ray tube of the present invention.
Figure 6:
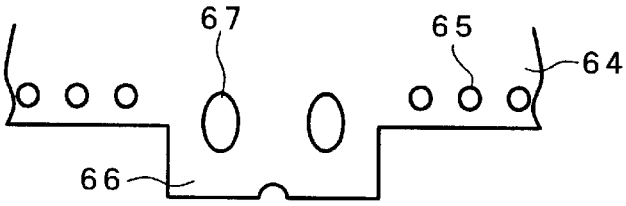
FIG. 6 is a side view of an essential part for explaining still another example of a tongue portion of a color selection electrode used in the color cathode ray tube of the present invention.

FIG. 5 to FIG. 8 are plan views showing other examples of tongue portions of the color selection electrodes used in the color cathode ray tube of the present invention. First of all, FIG. 5 shows the example where stress absorption holes 55 are formed in a skirt portion 54 parallel to stress absorption holes 57 formed in a tongue portion 56. Then, FIG. 6 shows the example where stress absorption holes 67 having an elliptical shape are formed in a tongue portion 66. In the drawing, numeral 64 indicates a skirt portion and 65 indicates stress absorption holes formed on the skirt portion 64. The total opening area of the stress absorption holes 67 is set approximately equal to the total opening area of the stress absorption holes 57 shown in FIG. 5.

Figure 7:
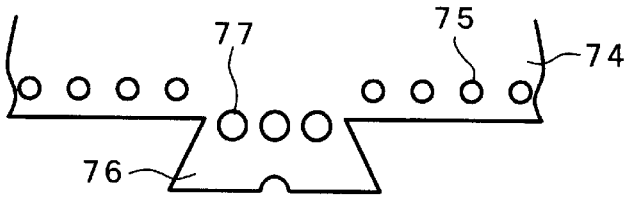
FIG. 7 is a side view of an essential part for explaining a further example of a tongue portion of a color selection electrode used in the color cathode ray tube of the present invention.

Further, FIG. 7 shows an example where a tongue portion 76 provided with stress absorption holes 77, has a proximal portion thereof narrowed compared to a distal end thereof, a fixing portion of the distal end portion has width sufficient for securing by welding, and the proximal end portion has a structure which can reduce a warp amount of skirt portion 74. In the drawing, numeral 75 indicates stress absorption holes.

Figure 8:
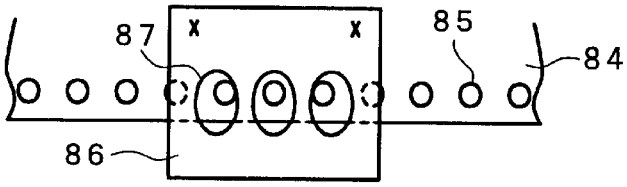
FIG. 8 is a side view of an essential part for explaining a still further example of a tongue portion of a color selection electrode used in the color cathode ray tube of the present invention.
Figure 9A:
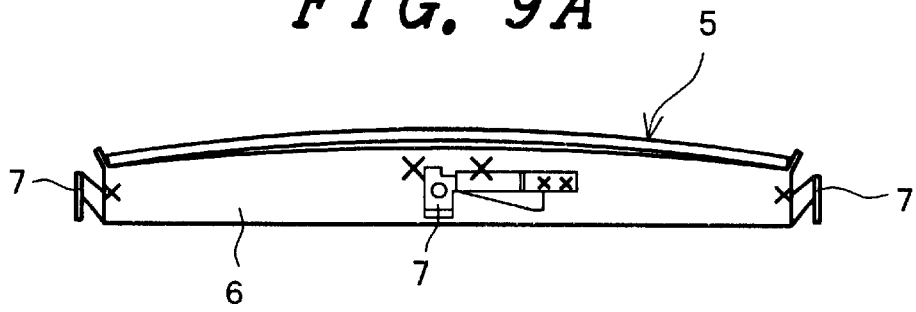
FIG. 9A, FIG. 9B, FIG. 9C and FIG. 9D are a side view, a plan view, a cross-sectional view of an essential part and a perspective view respectively showing an example of a shadow mask assembly used in the color cathode ray tube of the present invention.
Figure 9B:
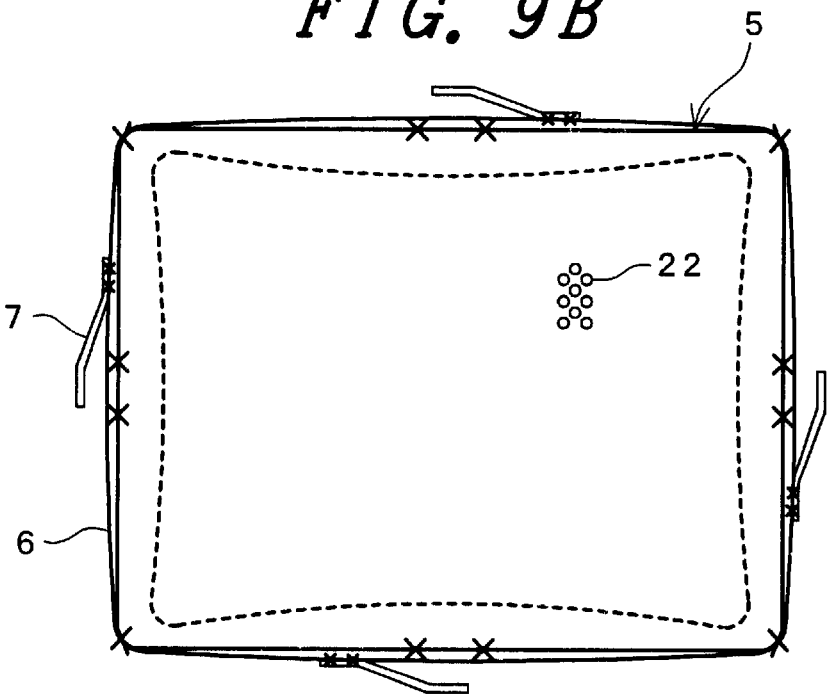
Figure 9C:
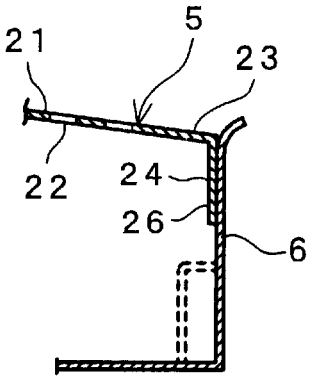
Figure 9D:
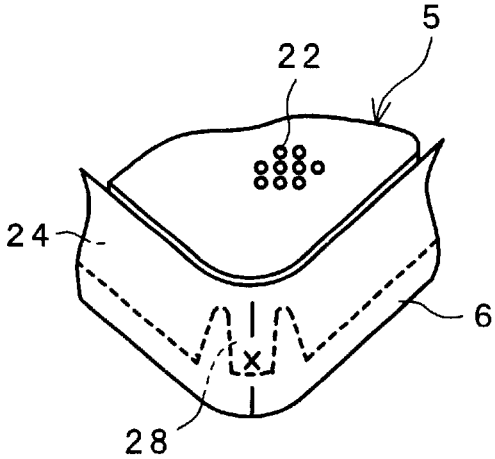

FIG. 8 shows an example where a tongue portion 86 which is prepared separately is fixedly secured to a skirt portion 84. This separate tongue portion 86 is provided with stress absorption holes 87 and the skirt portion 84 is provided with stress absorption holes 85. By using the separate tongue portion 86, it becomes possible to reduce a warp amount of the skirt portion 84.

FIG. 9 shows a shadow mask assembly which is formed by fixedly securing a shadow mask and a mask frame to each other, wherein (a) is a side view, (b) is a plan view, (c) is a cross-sectional view of an essential part, showing the securing positions and (d) is a perspective view of a corner portion. Parts which are identical to the parts shown in respective drawings which are described heretofore are given same numerals.

In FIG. 9, the skirt portions 24, tongue portions 26 and corners members 28 of the shadow mask 5 are inserted into the inside of the mask frame 6 and the tongue portions 26 and the corner members 28 are fixedly secured to the mask frame 6 at positions indicated by a mark × by welding. Springs 7 are fixedly secured to respective sides of the mask frame 6 by welding. Further, the shape of the mask frame may be provided with a step as shown by a dotted line, for example.

The present invention is not limited to the embodiments described heretofore and various modifications can be made without departing from the scope of the gist of the present invention as set forth in appended claims.

As has been described heretofore, according to a typical constitution of the present invention, by providing tongue portions which are protruded from the distal ends of the skirt portions of the shadow mask and forming a plurality of stress absorption holes respectively in the skirt portions and the tongue portions, a warp amount of the skirt portions derived from the spring back after shaping of the shadow mask can be reduced and, furthermore, the occurrence of the displacement derived from the tongue portions after fixedly securing the an shadow mask and the mask frame to each other can be prevented whereby the deformation of the shadow mask is suppressed and hence, a color cathode ray tube having an excellent color purity can be obtained.

What is claimed is:

1. A color cathode ray tube comprising:

an evacuated envelope including a panel portion having a phosphor film formed on an inner surface thereof, a neck portion accommodating an electron gun, and a funnel portion connecting the neck portion and the panel portion, a color selection electrode including a main surface which faces the phosphor film and in which a plurality of electron beam apertures are formed, skirt portions bent from the main surface in the direction toward the neck portion, and tongue portions which are protruded from the skirt portions in the direction away from the main surface, and a mask frame holding the color selection electrode by fixedly securing the tongue portions, wherein the improvement being characterized in that stress absorption hole portions are formed in the tongue portions of the color selection electrode, and the distance from a neck-side end portion of the tongue to the stress absorption hole portions is set equal to or more than 3 mm.

2. A color cathode ray tube according to claim 1, wherein the stress absorption hole portion has a plurality of stress absorption holes formed in the tongue portion.

3. A color cathode ray tube according to claim 2, wherein stress absorption holes formed in the tongue portion are arranged in the outer peripheral direction of main surface.

4. A color cathode ray tube according to claim 1, wherein an opening area of the stress absorption hole portions formed in the tongue portions occupies equal to or more than 25% of an area of the tongue portions.

5. A color cathode ray tube according to claim 1, wherein stress absorption hole portions are formed in the skirt portions of the color selection electrode.

6. A color cathode ray tube according to claim 5, wherein the stress absorption hole portions formed in the tongue portions and the stress absorption hole portions formed in the skirt portions are different in dimension.

7. A color cathode ray tube according to claim 6, wherein the stress absorption hole portions formed in the tongue portions are larger than the stress absorption hole portions formed in the skirt portions in dimension.

8. A color cathode ray tube according to claim 5, wherein the stress absorption hole portions are formed in regions except for corner portions of the color selection electrode and portions disposed at both sides of the corner portions.

9. A color cathode ray tube according to claim 1, wherein the second tongue portions which are protruded from the skirt portions in the direction away from the main surface are provided to the corner portions of the color selection electrode, and the second tongue portions are fixedly secured to the mask frame.

10. A color cathode ray tube comprising:

an evacuated envelope including an approximately rectangular panel portion having a phosphor film formed on an inner surface thereof, accommodating an electron gun, and a funnel portion connection the neck portion of the panel portion, an approximately rectangular color selection electrode including a main surface which faces the phosphor film and in which a plurality of electron beam apertures are formed, skirt portions bent from the main surface in the direction toward the neck portion, and tongue portions which are protruded from the skirt in the direction away from the main surface, and a mask frame holding the color selection electrode by fixedly securing the tongue portions therein, wherein the improvement being characterized in the stress absorption hole portions are formed in the tongue portions of the color selection electrode, the equivalent radius of curvature of the main surface along the longitudinal axis is set to equal to or more than 1250 mm, and the distance from a neck-side end portion of the tongue portions to the stress absorption hole portions is set to equal to or more than 3 mm.

11. A color cathode ray tube according to claim 10, wherein the stress absorption hole portion has a plurality of stress absorption holes formed in the tongue portion.

12. A color cathode ray tube according to claim 11, wherein stress absorption holes formed in the tongue portion are arranged in the outer peripheral direction of main surface.

13. A color cathode ray tube according to claim 10, wherein an opening area of the stress absorption hole portions formed in the tongue portions occupies equal to or more than 25% of an area of each tongue portion.

14. A color cathode ray tube according to claim 10, wherein the stress absorption hole portions is formed in the skirt portions of the color selection electrode.

15. A color cathode ray tube according to claim 14, wherein the stress absorption hole portions formed in the tongue portions and the stress absorption hole portions formed in the skirt portions are different in dimension.

16. A color cathode ray tube according to claim 15, wherein the stress absorption hole portions formed in the tongue portions are larger than the stress absorption hole portions formed in the skirt portions in dimension.

17. A color cathode ray tube according to claim 14, wherein the stress absorption hole portions formed in the skirt portions are formed in regions except for corner portions of the color selection electrode and portions disposed at both sides of the corner portions.

18. A color cathode ray tube according to claim 10, wherein the second tongue portions which are protruded from the skirt portions in the direction away from the main surface are provided to the corner portions of the color selection electrode, and the second tongue portions are fixedly secured to the mask frame.

19. A color cathode ray tube according to claim 1, wherein the color selection electrode has a region thinned thereof excluding the main surface and part of the tongue portions.

* * * * *